US005528772A

United States Patent [19]

Cheek

[11] Patent Number: 5,528,772

[45] Date of Patent: Jun. 25, 1996

[54] PROTECTIVE GLOVE

[76] Inventor: Jesse E. Cheek, 1614 Hedrick St., Newton, N.C. 28658

[21] Appl. No.: 350,526

[22] Filed: Dec. 7, 1994

[51] Int. Cl.[6] ..... A41D 19/00; A41D 13/10

[52] U.S. Cl. ..... 2/161.1; 2/19; 2/20

[58] Field of Search ..... 2/16, 19, 20, 159, 2/161.1, 161.2, 161.5, 161.6, 162, 163, 907

[56] References Cited

U.S. PATENT DOCUMENTS

| | | | |
|---|---|---|---|
| 1,479,771 | 1/1924 | Campbell | 2/159 X |
| 1,612,757 | 12/1926 | Wells | 2/162 |
| 2,025,710 | 12/1935 | Beemer | 2/20 X |
| 2,596,349 | 5/1952 | Thurlow et al. | 2/159 X |
| 3,581,312 | 5/1969 | Nickels | 2/20 X |
| 4,559,646 | 12/1985 | Ertl | 2/161.6 X |
| 4,630,318 | 12/1986 | Aoki . | |
| 4,658,441 | 4/1987 | Smith . | |
| 4,742,578 | 5/1988 | Seid | 2/16 X |
| 4,748,690 | 6/1988 | Webster . | |
| 4,787,376 | 11/1988 | Eisenberg . | |
| 4,928,320 | 5/1990 | Aoki . | |
| 4,958,384 | 9/1990 | McCrane . | |
| 4,987,611 | 1/1991 | Maye . | |
| 5,004,227 | 4/1991 | Hoffman . | |
| 5,168,578 | 12/1992 | Stanley . | |
| 5,173,963 | 12/1992 | Greenberg . | |

FOREIGN PATENT DOCUMENTS

| | | | |
|---|---|---|---|
| 392504 | 5/1933 | United Kingdom | 2/20 |

*Primary Examiner*—Paul C. Lewis

[57] ABSTRACT

A protective device to protect the palm, index finger and thumb which may be worn inside a conventional baseball or softball glove is provided. The protective device comprises a padded catching panel and flexible back panel which are connected along their margins to form a glove-like arrangement. The index finger, thumb, and palm of the athlete's hand are protected by the catching panel to minimize pain from impact of a baseball, to reduce instances of injuries, and to distribute the impact forces among a greater surface area caused by a ball caught at great velocity.

19 Claims, 2 Drawing Sheets

PROTECTIVE GLOVE

FIELD AND BACKGROUND OF THE INVENTION

The present invention relates to a protective glove with a padded surface to protect the hand from the painful impact and threat of injury of a fast moving article. The present invention may be used by athletes involved in active sports such as baseball or softball or people involved in industrial job activities requiring the use of the hands. The present invention is particularly beneficial in active sports such as baseball or softball because it protects the palm, thumb, and index finger of the athlete's hand by providing a padded surface to absorb the shock of the ball being caught. It also distributes the impact forces of the ball over a greater area of the hand, thereby reducing the threat of injury.

Athletes involved in sports such as baseball are constantly faced with the stinging sensation and pain felt when they catch a ball; particularly one which is thrown at a high speed. Not only does this pose a constant threat of injury and pain to the hand, but it also lessens the player's confidence while participating in the sport. This is a particular problem with young children wherein a child may avoid playing baseball or softball all together because of the pain he or she experiences in catching the ball. Moreover, if a child fears the stinging sensation caused by catching the ball, he or she may not aggressively attempt to catch the baseball or softball.

While baseball gloves are designed to protect the player's hand and to assist in catching the ball, these gloves do not provide protection necessary to minimize the pain and reduce instances of injury. Protective palm pads worn inside a baseball glove are known in the prior art, however, these devices are accompanied by several disadvantages. These devices frequently shift within the glove and do not provide sufficient surface area to dissipate the impact forces of a ball.

An example of such is disclosed by U.S. Pat. No. 4,987,611 to Maye which provides a protective device worn by a baseball player inside the glove but which only protects a portion of the palm and does not protect a large portion of the thumb or any of the index finger. Moreover, the device of Maye does not encircle the entire palm, and thus, it would be more difficult to maintain the device in its proper location, particularly after catching a baseball.

Devices which cover the entire hand are also known in the prior art. Although these devices may not shift location within the baseball glove, they are often bulky and inhibit the dexterity of the baseball player's hand while playing ball. An example of such is U.S. Pat. No. 4,748,690 to Webster which provides a protective glove which covers the entire hand and which is a somewhat complex structure involving a glove and glove cushions. Devices of this type are more complicated to manufacture and therefore more costly to the athlete. Moreover, although these devices do protect the athlete's hand more than the protective palm pads, they substantially lessen the flexibility the baseball player's hand. A larger baseball or softball glove would be required to utilize a device such as that disclosed by Webster.

It is thus an object of the present invention to provide a protective device which can be worn by athletes, particularly those involved in catching baseballs or softballs, to avoid pain and to reduce instances of injuries to the hand. Thus, the athlete will possess a higher degree of confidence knowing that the impact forces of the oncoming ball will not produce its usual attendant pain.

It is a further object of the present invention to provide a protective baseball glove which is easier to manufacture, less costly to the athlete, and does not involve a complex structure.

It is yet another object of the present invention to provide a protective padding which maintains its proper position within a conventional baseball or softball glove and yet which is easily and comfortably fitted within the glove without hindering the dexterity of the hand.

SUMMARY OF THE INVENTION

The protective glove of the present invention protects the athlete's palm, thumb, and index finger by providing a padded surface which covers substantially all of these areas yet leaving the remaining fingers free. The padded surface of the present invention is streamlined and formed of a unitary material which is flexible such that the dexterity of the player's hand is not inhibited. The present invention comprises a thin, flexible back portion which is sewn together with the protective padded surface to form a glove which completely encircles the hand to prevent the device from shifting from its proper location. The protective device of the instant invention is sized to easily fit within conventional baseball gloves. It also can be worn inside various gloves without having to repurchase the more costly outside glove. This is a particular cost benefit to young children whose hands are constantly growing as the present invention is formed of stretchable fabrics.

The present invention pertains to a protective device to be worn about the hand and wrist of an athlete to protect the palm, index finger, and thumb of an athlete's hand and to lessen the impact of catching balls while the athlete engages in athletic activities. The protective device includes a padded catching panel including a thumb protective portion, an index finger protective portion, and a palm protective portion which is connected to a similarly configured flexible back panel. These panels are positioned in overlying relation, such that the seam connecting them extends along the sides of the hand and around the thumb and index finger, thereby leaving an opening along the top margin for the remaining three fingers to extend therethrough and an opening along the wrist margin to permit the hand to be inserted within the protective glove. The seams around the periphery of the index finger, thumb and side margins form a substantially glove-like enclosure for receiving the thumb, index finger, and palm of the hand either fully as in the preferred embodiment or partially as in a second embodiment.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE DRAWINGS

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Figure 1:
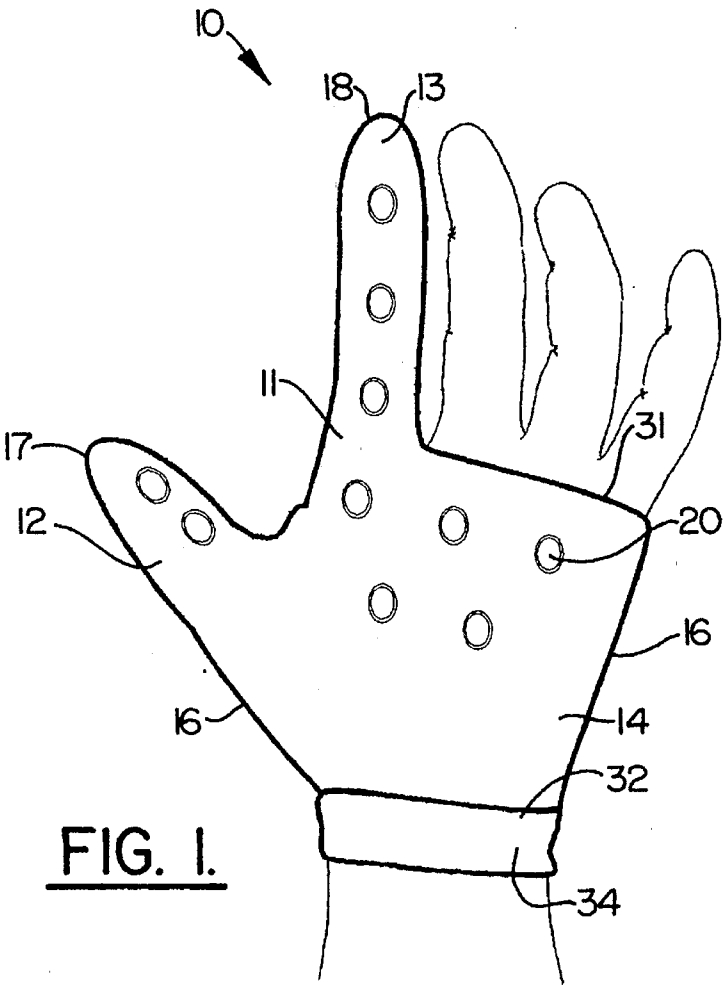
FIG. 1 is a view of one side of the protective device of the present invention as it is worn on an athlete's hand.

FIG. 1 illustrates a protective device or glove according to the present invention worn about an athlete's hand viewing the palm or catching side of the hand. The protective glove 10 consists of a padded catching panel 11 which includes a thumb protective portion 12, an index finger protective portion 13, and a palm protective portion 14. The catching panel 11 is outlined by opposing side margins 16 which extend along the sides of the hand. Side margin 16, on one side, extends from the base of the athlete's smallest finger to the wrist and, on the other side, from the base of the thumb to the athlete's wrist. The catching panel 11 is further defined by a thumb margin 17 which extends around the thumb of the athlete. Furthermore, the index finger protective portion 13 is defined by an index finger margin 18 which extends about the periphery of the athlete's index finger.

The catching panel 11 provides a cushioning effect to protect the hand upon impact from an oncoming baseball or softball. This panel 11 may be formed of any material which provides cushioning, padding, or shock deadening properties. Suitable materials include open cell foams, closed cell foams, and synthetic or natural rubber materials such as NEOPRENE in the most preferred embodiment. Particularly preferred is a synthetic rubber material having shock deadening properties, such as the product sold under the trademark ZORBATHANE. Preferably, the material of panel 11 has a thickness of from about 1/16 inch to 1/4 inch. The materials of the preferred embodiment are chosen because they provide the requisite amount of protection to the palm, thumb, and index finger while at the same time do not inhibit the dexterity of the athlete's hand.

As seen in FIG. 1, catching panel 11 is formed from a unitary material such that a substantially continuous structure is provided. This configuration ensures that the present invention is not bulky when worn within a baseball or softball glove and there is no seam across the palm, index finger, or thumb. Furthermore, vents 20 are provided in predetermined locations of panel 11 to ventilate the athlete's hand, a particular benefit when the present invention is worn within a baseball or softball glove. As shown in FIG. 1, these vents 20 are located substantially on the catching portion of the index finger protective portion 13 and thumb protective portion 12 and in predetermined locations of the palm protective portion 14. These locations are most apt to be contacted by the baseball or softball which is being caught. While the vents 20 depicted in FIG. 1 illustrate the most preferred embodiment of the invention, the present invention would equally protect the hand without the addition of these vents, and the present invention is not limited to the precise locations of the vents 20. These vents may be located anywhere along the glove including along the flexible back panel 21 to ventilate the athlete's hand.

Figure 2:
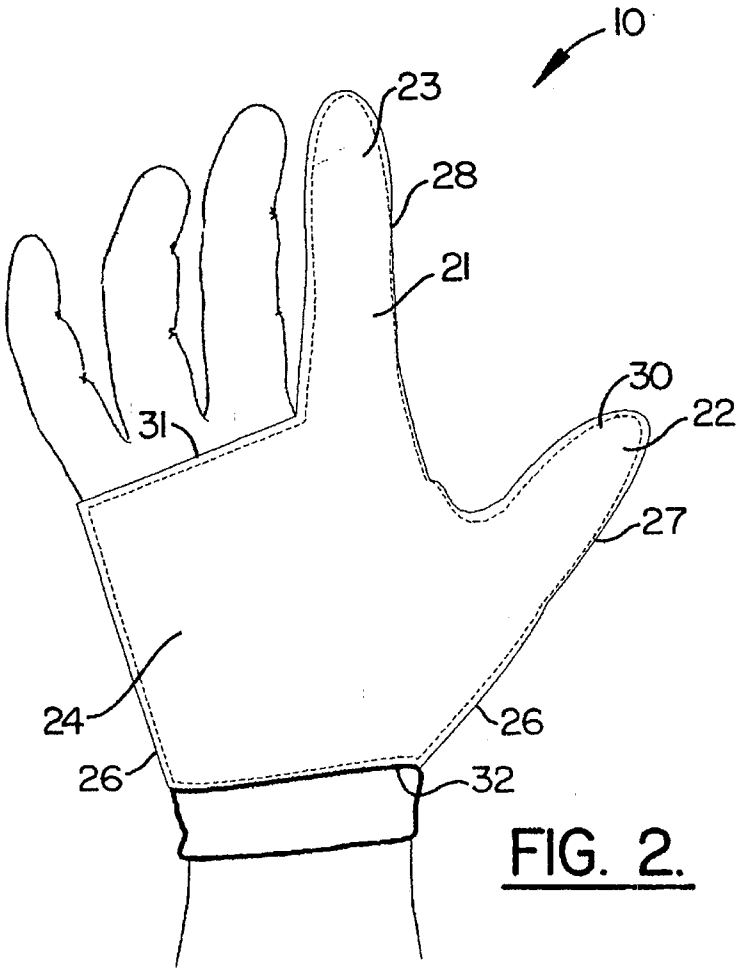
FIG. 2 is a view of the opposite side of the device shown in FIG. 1.

FIG. 2 illustrates the back side of the protective inner glove device 10 of the present invention as it is worn about an athlete's hand. The flexible back panel 21 comprises a similar configuration as the padded catching panel 11 illustrated in FIG. 1. More specifically, the flexible back panel 21 comprises a thumb portion 22, index portion 23, and the back side of the hand portion 24. The flexible back panel 21 is formed in substantially the same configuration as the panel 11 and likewise contains opposing side margins 26, thumb margin 27, and index margin 28.

The flexible back panel 21 of the protective glove 10 is formed from a single piece of material such that a unitary and continuous structure is formed. Suitable materials include woven, knitted or netted fabrics, or nonwoven fabrics. While any flexible fabric may be utilized as a flexible back panel 21, in the most preferred embodiment, a knitted fabric made of stretch yarns, such as LYCRA, is utilized because of its elastic characteristics. An elastic or stretch fabric advantageously holds the glove snugly on the hand and accommodates hands of various sizes. The back panel 21 secures the present invention on the athlete's hand without causing excess bulk. Also in the most preferred embodiment, the flexible back panel 21 is not provided with any padding as is the protective padded panel 11 and thereby easily fits within a baseball or softball glove.

The padded catching panel and flexible back panel 21 are secured to one another by a seam 30 which secures the side margins 16, the thumb margin 17, and index margin 18 of the catching panel 11 with the side margins 26, thumb margin 27, and index margin 28, of the flexible back panel 21. The seam is generally shown at 30 in FIG. 2. While the most preferred embodiment is shown in FIGS. 1 and 2 wherein the index finger and thumb are completely encased by the protective device of the present invention, the present invention is not limited to this embodiment. It may not be desired by some athletes to have their entire index finger or thumb fully received within the protective device of the present invention. Thus, in an alternative construction, the glove may have an open-ended index finger protective portion and/or an open-ended thumb protective portion so that the tip of the index finger and/or the tip of the thumb is exposed.

As seen in FIGS. 1 and 2, the padded catching panel 11 and flexible back panel 12 are provided with unsewn top margins 31 and unconnected bottom margins 32. Thus, the fingers other than the index finger and thumb are not received within the protective device of the instant invention. Thus, the bulk of the present invention is greatly reduced as it is unnecessary to protect these fingers further than the protection provided by a conventional baseball glove. The bottom margins 32 are left unconnected such that the user may insert his or her hand into the device to be worn. The bottom margins 32 are shown in FIGS. 1 and 2 and, after the panels are connected, will encircle the wrist.

Figure 3:
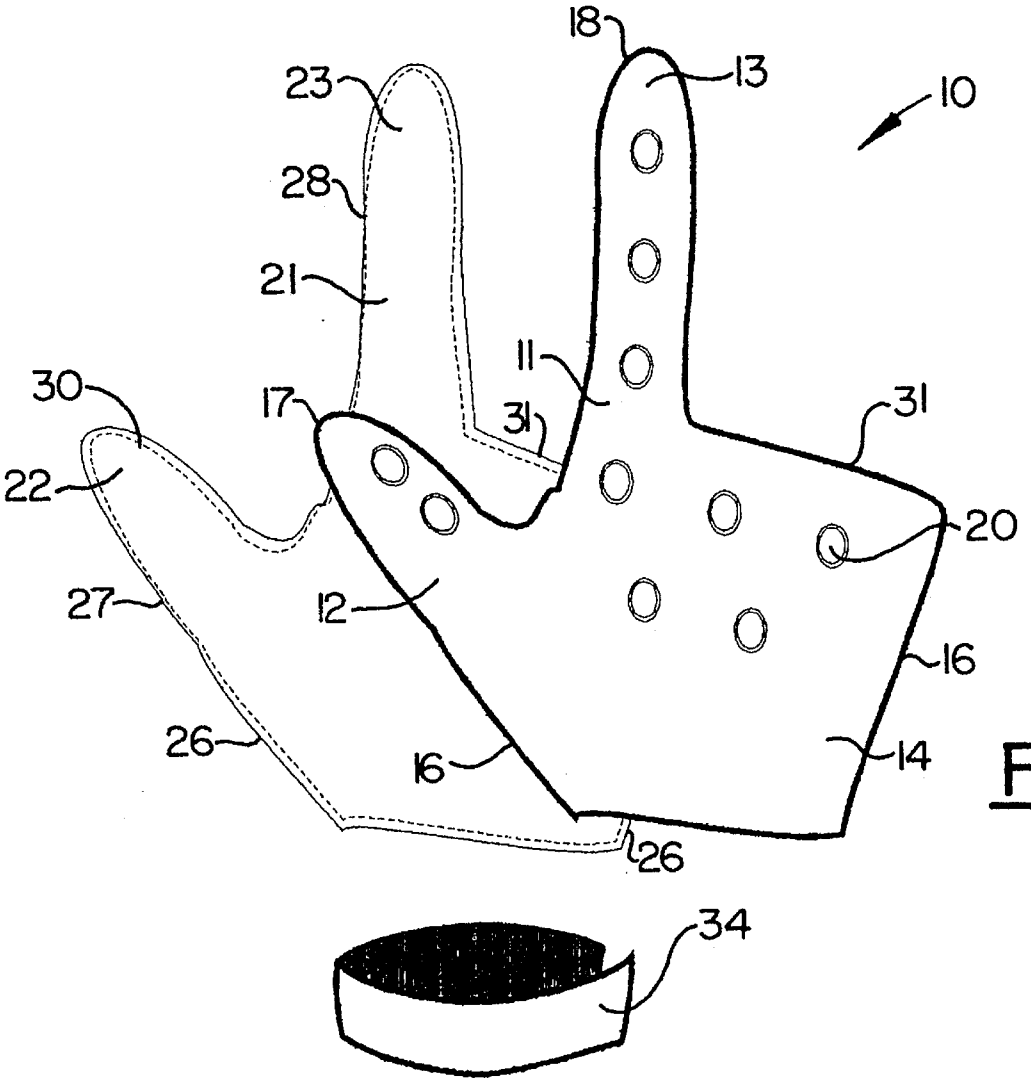
FIG. 3 is an exploded view of the various portions of the protective device of the present invention.

While the materials utilized in forming the padded catching panel 11 and flexible back panel 21 in the most preferred embodiment comprise somewhat elastic material, particularly the flexible back panel 21, a wrist attaching member 34 is preferably provided to further secure the present invention on the athlete. As best seen in FIG. 3, wrist attaching member 34 is secured along the bottom margins 32 of the panels 11 and 21 to further secure the device on the athlete's hand. While any wrist attaching member may be used, in the most preferred embodiment a highly elastic material is utilized. A variation of this embodiment, however, would be a non-elastic wrist attaching member comprising a fastener such as Velcro or the like to secure the present invention around the athlete's wrist. The unitary elastic structure depicted in FIG. 3 is less bulky, is easily applied to the athlete's hand, and more comfortably fits within a conventional baseball glove.

While particular embodiments of the invention have been described, it will be understood, of course, the invention is not limited thereto since modifications may be made by those skilled in the art, particularly in light of the foregoing teachings. It is, therefore, contemplated by the appended claims to cover any such modifications that incorporate those features of these improvements in the true spirit and scope of the invention.

That which is claimed:

1. A protective device to be worn about the hand and wrist of an athlete to protect the palm, index finger, and thumb of an athlete's hand and to lessen the impact of catching balls while the athlete engages in athletic activities comprising:

a front catching panel consisting essentially of padding material, said catching panel including a thumb protective portion, an index finger protective portion, and a palm protective portion;

a substantially unpadded flexible back panel of a configuration substantially corresponding to that of said catching panel and including a thumb portion, an index finger portion, and a back side of the hand portion;

said catching panel and said back panel being positioned in overlying relation, with each panel comprising opposing side margins defined along opposite sides of the hand, a thumb margin along peripheral edges of said thumb portions, an index finger margin along peripheral edges of said index finger portions, a top margin defined by the base of the remaining fingers of the hand, and a bottom margin portion defined by the wrist of the hand;

a seam connecting said catching panel directly to said back panel along said side margins, said thumb margin and index finger margin to form a substantially glove-like enclosure for receiving the thumb, index finger, and palm of the hand;

the top margins of the panels being unconnected so that the remaining fingers of the hand may project from the glove-like enclosure; and the bottom margins of the panels being unconnected to accommodate application of the device onto the hand and to substantially encircle the wrist.

2. A device according to claim 1 further comprising a wrist attaching member carried by said panels to secure said device around the wrist of the athlete's hand.

3. A device according to claim 2, wherein said attaching member is formed of an elastic material.

4. A device according to claim 2, wherein said attaching member is connected to said bottom margins of each of said panels.

5. A device according to claim 1, wherein said catching panel is a substantially continuous and unitary structure.

6. A device according to claim 5, wherein said padding material is formed of foam material.

7. A device according to claim 5, wherein said padding material is formed of rubber.

8. A device according to claim 7, wherein said padding material is formed of a shock deadening synthetic rubber.

9. A device according to claim 1 wherein at least one vent is provided in said catching panel to ventilate the athlete's hand when wearing said device.

10. A device according to claim 9, wherein plural vents are provided which are located at predetermined areas of the index finger, thumb, and palm portions of said catching panel.

11. A device according to claim 1, wherein said back panel is a substantially continuous, unitary structure.

12. A device according to claim 11, wherein said back panel is formed of a flexible stretch fabric.

13. A device according to claim 1, wherein said device is sized to be worn inside a conventional baseball glove.

14. A protective device to be worn about the hand and wrist of an athlete to protect the palm, index finger, and thumb of an athlete's hand and to lessen the impact of catching balls while the athlete engages in athletic activities comprising:

a front protective catching panel consisting essentially of padding material, said catching panel including a thumb protective portion configured to fully cover the thumb of the athlete, an index finger protective portion configured to fully cover the index finger of the athlete, and a palm protective portion to fully cover the palm of athlete;

a substantially unpadded flexible back panel of a configuration substantially corresponding to that of said catching panel and including a thumb portion configured to fully cover the back side of the athlete's thumb, an index finger portion configured to fully cover the back side of athlete's index finger, and a back side of the hand portion to fully cover the back side of the hand;

said catching panel and said back panel being positioned in overlying relation, with each panel comprising opposing side margins defined along opposite sides of the hand, a thumb margin along peripheral edges of said thumb portions, an index finger margin along peripheral edges of said index finger portions, a top margin defined by the base of the remaining fingers of the hand, and a bottom margin portion defined by the wrist of the hand;

a seam connecting said catching panel directly to said back panel along said side margins, said thumb margin and index finger margin to form a substantially glove-like enclosure for fully receiving the thumb, index finger, and palm of the hand;

the top margins of the panels being unconnected so that the remaining fingers of the hand may project from the glove-like enclosure; and the bottom margins of the panels being unconnected to accommodate application of the device onto the hand and to substantially encircle the wrist.

15. A device according to claim 14 further comprising a wrist attaching member carried by said panels to secure said device around the wrist of the athlete's hand.

16. A device according to claim 14 wherein said catching panel is a substantially continuous and unitary structure.

17. A device according to claim 14, wherein said back panel is a substantially continuous, unitary structure.

18. A device according to claim 14 wherein at least one vent is provided in said catching panel to ventilate the athlete's hand when wearing said device.

19. A protective device to be worn about the hand and wrist of an athlete to protect the palm, index finger, and thumb of an athlete's hand and to lessen the impact of catching balls while the athlete engages in athletic activities comprising:

a substantially continuous and unitary front protective catching panel consisting essentially of padding material, said catching panel including a thumb protective portion, an index finger protective portion, and a palm protective portion;

a substantially continuous and unitary flexible back panel of a configuration substantially corresponding to that of said catching panel and including a thumb portion, an index finger portion, and a back side of the hand portion wherein said back panel is substantially unpadded;

said catching panel and said back panel being positioned in overlying relation, with each panel comprising opposing side margins defined along opposite sides of the hand, a thumb margin along peripheral edges of said thumb portions, an index finger margin along peripheral edges of said index finger portions, a top margin defined by the base of the remaining fingers of the hand, and a bottom margin portion defined by the wrist of the hand;

a seam connecting said catching panel directly to said back panel along said side margins, said thumb margin and index finger margin to form a substantially glove-like enclosure for receiving the thumb, index finger, and palm of the hand;

the top margins of the panels being unconnected so that the remaining fingers of the hand may project from the glove-like enclosure;

the bottom margins of the panels being unconnected to accommodate application of the device onto the hand and to substantially encircle the wrist;

a wrist attaching member carried by said bottom margins of each of said panels to secure said device around the wrist of the athlete's hand; and plural vents located at predetermined areas of the index finger, thumb, and palm portions of said catching panel to ventilate the athlete's hand when wearing said device.

* * * * *